US010559913B2

(12) United States Patent
Schönfeld et al.

(10) Patent No.: US 10,559,913 B2
(45) Date of Patent: Feb. 11, 2020

(54) HOLDING FRAME WITH GUIDE ELEMENT FOR PLUG CONNECTOR MODULES

(71) Applicant: HARTING Electric GmbH & Co. KG, Espelkamp (DE)

(72) Inventors: Alexander Schönfeld, Osnabrück (DE); Heiko Herbrechtsmeier, Bünde (DE); Heiko Meier, Minden (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/069,846

(22) PCT Filed: Jan. 17, 2017

(86) PCT No.: PCT/DE2017/100022
§ 371 (c)(1),
(2) Date: Jul. 12, 2018

(87) PCT Pub. No.: WO2017/125107
PCT Pub. Date: Jul. 27, 2017

(65) Prior Publication Data

US 2019/0036268 A1 Jan. 31, 2019

(30) Foreign Application Priority Data

Jan. 19, 2016 (DE) ..... 10 2016 100 794

(51) Int. Cl.
*H01R 13/518* (2006.01)
*H01R 13/514* (2006.01)
(Continued)

(52) U.S. Cl.
CPC ..... *H01R 13/518* (2013.01); *H01R 13/506* (2013.01); *H01R 13/514* (2013.01); *H01R 13/665* (2013.01)

(58) Field of Classification Search
CPC .. H01R 13/506; H01R 13/514; H01R 13/518; H01R 13/665
(Continued)

(56) References Cited

U.S. PATENT DOCUMENTS 4,616,288 A 10/1986 Scholtholt et al.
5,795,174 A * 8/1998 Saito ..... H01R 13/518 439/310
(Continued)

FOREIGN PATENT DOCUMENTS

CN 202084755 U 12/2011
DE 197 07 120 C1 6/1998
(Continued)

OTHER PUBLICATIONS

German Office Action, dated Dec. 14, 2016, for German Application No. 10 2016 100 794.3, 4 pages.
(Continued)

*Primary Examiner* — Oscar C Jimenez
(74) *Attorney, Agent, or Firm* — Seed IP Law Group LLP

(57) ABSTRACT

The disclosure relates to a holding frame into which plug connector modules can be inserted. The holding frame has guiding means, whereby the holding frame can be aligned with a second holding frame in the plug-in direction so as to fit in a precise manner. Two holding frames which can be plugged together contain at least one respective pneumatic plug connector module. The first holding frame comprises a first pneumatic plug connector module, and the second holding frame comprises a second pneumatic plug connector module. The first pneumatic plug connector module is aligned with the second pneumatic plug connector module such that the modules can be plugged together. Such pneumatic plug connector modules are particularly sensitive to
(Continued)

wear when they are plugged together without being aligned relative to one another in an exact manner.

7 Claims, 3 Drawing Sheets

(51) Int. Cl.
*H01R 13/506* (2006.01)
*H01R 13/66* (2006.01)

(58) Field of Classification Search
USPC ..... 439/701
See application file for complete search history.

(56) References Cited

U.S. PATENT DOCUMENTS

| | | | | | |
|---|---|---|---|---|---|
| 6,004,162 | A * | 12/1999 | Harting | H01R 13/518 | 439/532 |
| 6,135,824 | A * | 10/2000 | Okabe | H01R 13/506 | 439/595 |
| 10,263,357 | B2 * | 4/2019 | Herbrechtsmeier | H01R 13/506 | |
| 2003/0194914 | A1 * | 10/2003 | Duck | G02B 6/381 | 439/701 |
| 2004/0053534 | A1 * | 3/2004 | Beneke | H01R 13/514 | 439/607.01 |
| 2004/0077223 | A1 * | 4/2004 | Reicharz | H01R 13/642 | 439/676 |
| 2007/0155252 | A1 * | 7/2007 | Ferderer | H01R 13/506 | 439/680 |
| 2009/0291579 | A1 * | 11/2009 | Farole | H01R 12/592 | 439/296 |
| 2012/0244754 | A1 | 9/2012 | Riepe et al. | | |
| 2016/0056567 | A1 * | 2/2016 | Dugo | H01R 9/2408 | 439/892 |
| 2016/0093980 | A1 * | 3/2016 | Beischer | H01R 13/514 | 439/345 |
| 2016/0276786 | A1 * | 9/2016 | Herbrechtsmeier | H01R 13/506 | |
| 2016/0285194 | A1 | 9/2016 | Herbrechtsmeier | | |
| 2017/0141518 | A1 | 5/2017 | Brüx et al. | | |
| 2017/0237209 | A1 * | 8/2017 | Loetkemann | H01R 13/518 | 439/540.1 |
| 2018/0241149 | A1 * | 8/2018 | Herbrechtsmeier | H01R 13/506 | |
| 2018/0248296 | A1 * | 8/2018 | Herbrechtsmeier | H01R 13/506 | |
| 2018/0248297 | A1 * | 8/2018 | Herbrechtsmeier | H01R 13/518 | |
| 2018/0254578 | A1 * | 9/2018 | Herbrechtsmeier | H01R 13/506 | |
| 2018/0269621 | A1 * | 9/2018 | Schonfeld | H01R 13/506 | |
| 2018/0269622 | A1 * | 9/2018 | Schonfeld | H01R 13/518 | |
| 2018/0277978 | A1 * | 9/2018 | Schonfeld | H01R 13/506 | |
| 2018/0309227 | A1 * | 10/2018 | Diessel | H01R 13/514 | |
| 2018/0358735 | A1 * | 12/2018 | Herron | H01R 13/518 | |

FOREIGN PATENT DOCUMENTS

| | | | |
|---|---|---|---|
| DE | 20 2010 005 095 | U1 | 9/2011 |
| EP | 0 749 178 | A2 | 12/1996 |
| EP | 0 860 906 | A2 | 8/1998 |
| EP | 1 353 412 | A2 | 10/2003 |
| RU | 2 172 048 | C2 | 8/2001 |
| RU | 2 516 310 | C2 | 5/2014 |
| SU | 1308207 | A1 | 4/1987 |
| WO | 2015/085995 | A1 | 6/2015 |
| WO | 2015/149757 | A2 | 10/2015 |

OTHER PUBLICATIONS

International Search Report and Written Opinion, dated Mar. 15, 2017, for International Application No. PCT/DE2017/100022, 15 pages. (with English Translation of Search Report).
International Preliminary Report on Patentability, dated Jul. 24, 2018, for International Application No. PCT/DE2017/100022, 9 pages.
Russian Office Action, dated May 6 2019, for Russian Application No. 2018129728/07, 7 pages.

* cited by examiner

HOLDING FRAME WITH GUIDE ELEMENT FOR PLUG CONNECTOR MODULES

BACKGROUND

Technical Field

The disclosure relates to a holding frame for plug-in connector modules.

Such holding frames serve to hold plug-in connector modules, the holding frame being fitted with various plug-in connector modules, and then inserted in a plug-in connector housing and screw-connected to the latter. The holding frame in this case must be mechanically stable, in order to be able to withstand the insertion and withdrawal forces that occur when the plug-in connection is being joined together or separated.

Description of the Related Art A holding frame for plug-in connector modules is known from DE 197 07 120 C1. The holding frame comprises two halves, which are connected to each other via a joint. Latching hooks of the plug-in connector modules engage in recesses of the lateral surfaces of the respective half. The joint, or the end joints, is/are arranged in the fastening ends of the holding frame. Upon the holding frame being screwed onto a fastening surface, the frame parts become aligned in such a manner that the lateral parts of the holding frame are aligned perpendicularly in relation to the fastening surface. The plug-in connector modules are thereby fixed in the holding frame.

The holding frames, together with plug-in connector modules fixed therein, are integrated in the plug-connector housing. When a plug-in connector is plugged together with a counter-plug-in connector, the plug-in connector modules should be aligned in a precision-fitting manner in relation to each other, since otherwise there is a high degree of wear on the modules on the plug-in side.

In order to ensure such a precision-fitting alignment, guide means are frequently provided on the plug-in connector housing. Often, however, such guide means do not correlate exactly with the mounting position of the holding frame, such that sensitive plug-in connector modules are nevertheless subjected to an appreciable degree of wear.

BRIEF SUMMARY

Embodiments of the present invention provide a holding frame which is such that the degree of wear to which the plug-in connector modules are subjected during the plug-in operation is slight.

Plug-in connector modules can be inserted in the holding frame according to embodiments of the invention. Following the insertion of the plug-in connector modules, the holding frame is screwed into a plug-in connector housing.

The holding frame has guiding devices or means, whereby the holding frame can be aligned in a precision-fitting manner in relation to a second holding frame in the plug-in direction. Both holding frames in this case are integrated in a plug-in connector housing or in a so-called mounting flange. A precision-fitting alignment means that the two holding frames are parallel to each other, and the frame edges, or the plug-in connector modules, are in exact alignment with each other. It is thereby ensured that the plug-in connector modules contained in the holding frames can be plugged together with little wear.

Preferably, the holding frame comprises two halves that can be connected to each other, a first half and a second half.

The two halves are connected to each other via a hinged joint. By way of the joint, the holding frame can be brought into an open position.

Advantageously, the holding frame has a parting plane, which runs parallel to the longitudinal sides of the halves. As described above, the holding frame has joints, by which the halves are hinged to each other and can be brought into an open position and a closed position.

In the open position, the holding frame can be fitted with plug-in connector modules. Open position means that the halves are at an angle $\alpha$ other than 180° in relation to each other along the parting line. Preferably, the angle is between 130° and 170°. An angle of between 155° and 165° has been found to be particularly advantageous. When the halves are in this angular position, the plug-in connector modules can be inserted particularly easily into the holding frame.

In the closed position, the plug-in connector modules are fixed in the holding frame. In the closed position, the halves assume an angle of approximately 180°, or precisely 180°, in relation to each other. Thus, in the closed position, the halves are substantially parallel to each other.

In an advantageous embodiment of the invention, the guiding devices or means comprise a guide element and a guide rail. Guiding can thereby be realized in an inexpensive manner.

It is particularly advantageous if the guide element additionally has fixing devices or means, by which the halves can be fixed in a parallel, or closed, position in relation to each other. The guide element thereby performs a double function. The holding frames may be fixed to each other in the closed position, such that no plug-in connector modules can fall out, and at the same time, in the plug-in operation, exact guiding can be realized by the holding frame. Since, in the case of the holding frames, such fixing devices or means should be provided anyway, this variant is easily manipulable, since no more parts are used than is usual. Moreover, this variant is inexpensive, since no further components are added, it being necessary merely to reconfigure one necessary component for a double function.

Preferably, the guide element has a guide sleeve, which can be gripped onto a guide rail of the second holding frame. The guide rail required for this purpose is likewise attached to the holding frame. Normally, two holding frames, equipped with plug-in connector modules, are plugged together. In this case, the guide sleeve of the guide element of the first holding frame grips onto the guide rail of the second holding frame, and vice versa.

It is advantageous if the holding frame has a grounding socket and a grounding pin. Normally, the grounding pin of the first holding frame is guided into the grounding socket of the second holding frame, and vice versa. A reliable grounding, which in many cases is technically necessary, is thereby achieved.

In a quite particularly advantageous embodiment of the invention, the guide rail is formed on the grounding socket. There is consequently no need for an additional projecting part to be formed on the holding frame. As a result, the holding frame according to this advantageous embodiment of the invention continues to be just as manipulable as the technically older version without guide devices or means.

BRIEF DESCRIPTION OF THE SEVERAL VIEWS OF THE DRAWINGS

An exemplary embodiment of the invention is represented in the drawings and explained in greater detail in the following. In the drawings.

The figures contain partly simplified, schematic representations. In some cases, identical references are used for elements that are the same, but possibly not identical. Differing views of the same elements may differ in scale.

DETAILED DESCRIPTION

Figure 1:
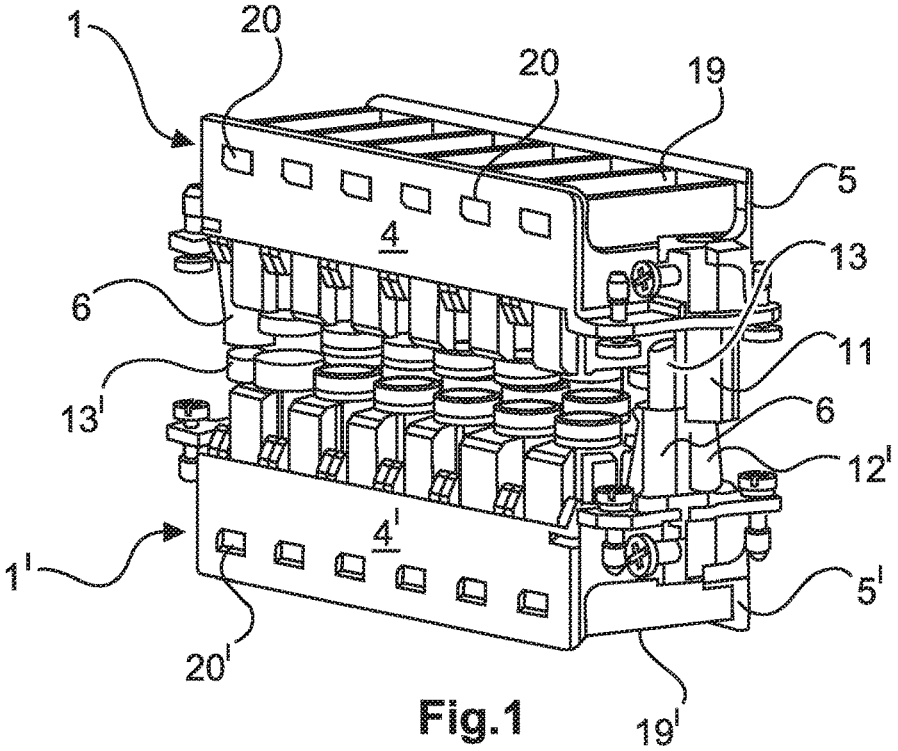
FIG. 1 shows a perspective representation from one viewpoint of two holding frames having plug-in connector modules, which are plug-connected to each other.
Figure 2:
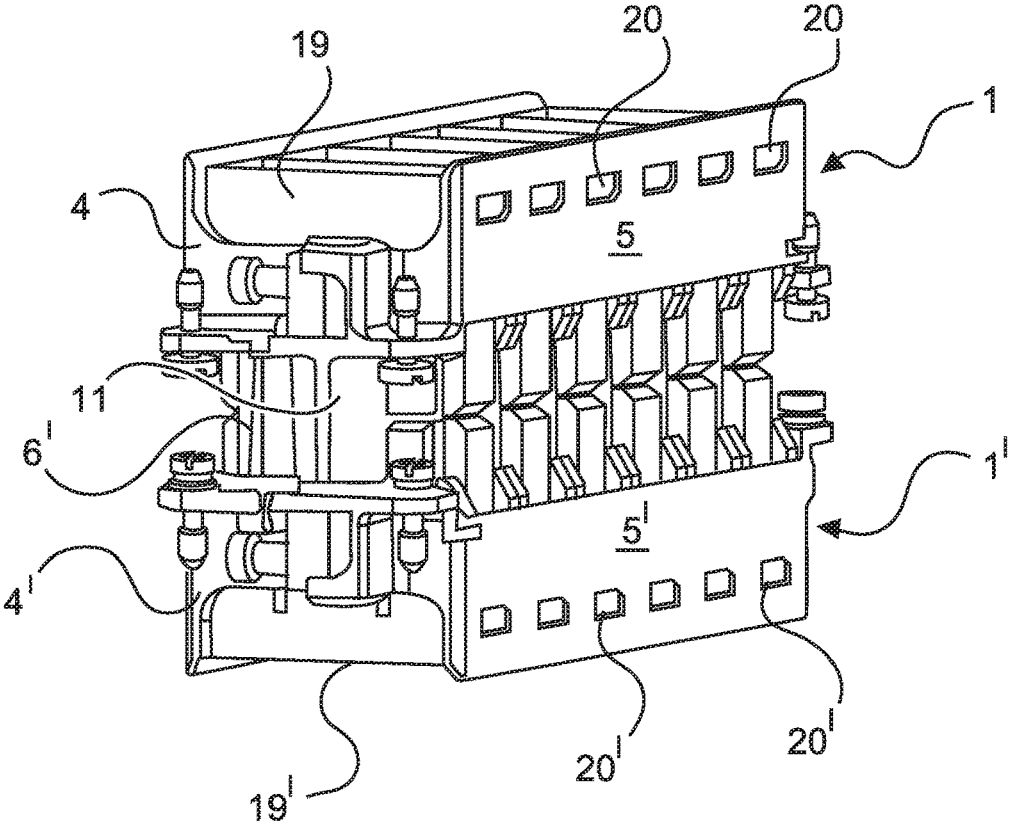
FIG. 2 shows a perspective representation from another viewpoint of the two holding frames having plug-in connector modules, which are plug-connected to each other.

FIG. 1 shows two holding frames 1, 1', which are filled with plug-in connector modules 19, 19' and plug-connected to each other. Normally, the holding frames 1, 1' are integrated into a plug-in connector housing or a mounting flange. For illustrative reasons, the plug-in connector housing, or the mounting flange, are not shown. Each holding frame 1, 1' comprises substantially two halves 4, 5, 4', 5', which are connected to each other via a joint.

Figure 5:
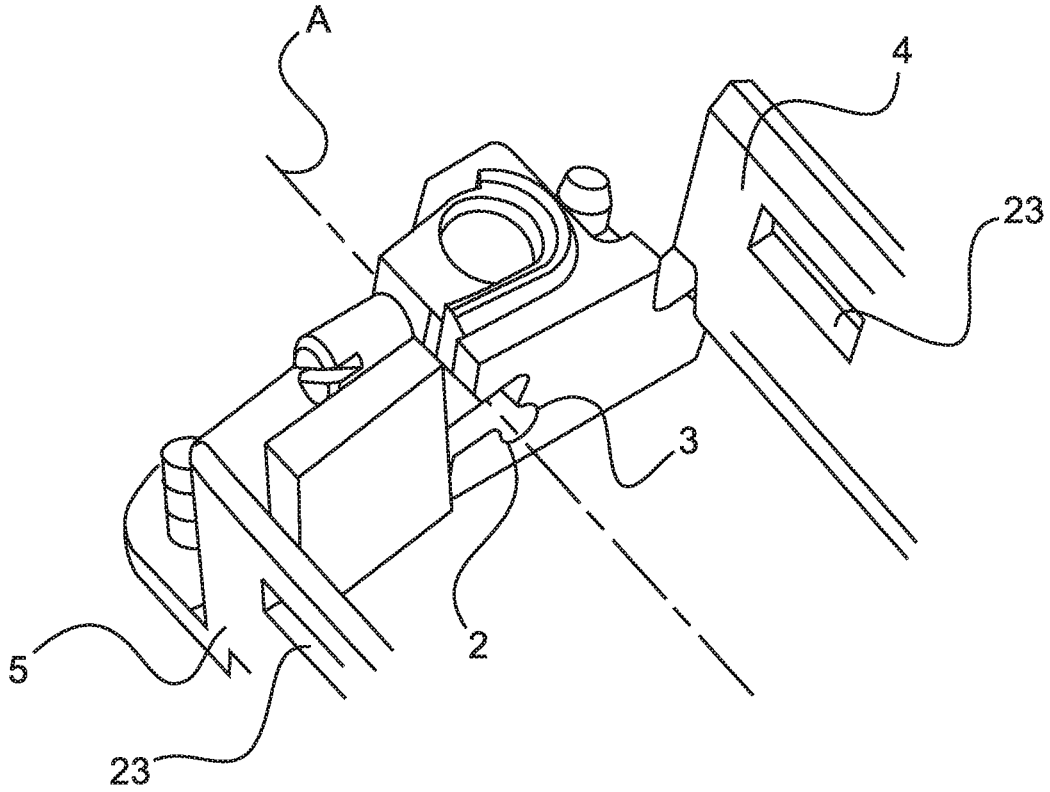
FIG. 5 shows a perspective detail of a portion of one of the holding frames.

The holding frame 1, 1' has a parting plane A, which runs parallel to the longitudinal sides of the halves 4, 5, 4', 5'. The hinged joint of the holding frame 1 can be seen in FIG. 5. One half 5 has a joint head 2 at the respective end faces, which joint head engages in a joint receiver 3, provided for this purpose, of the opposing half 4. FIG. 5 shows the open position of the holding frame 1. In the open position, the holding frame 1 can be fitted with plug-in connector modules 19. In the closed position, the halves 4, 5 are parallel to each other.

Figure 3:
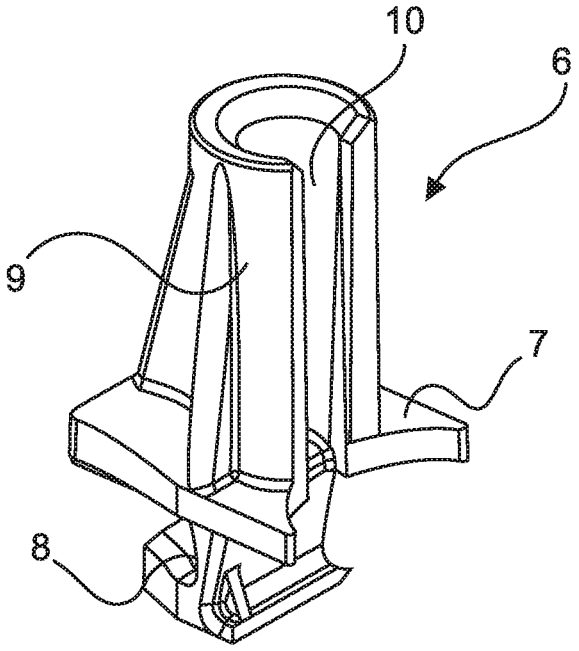
FIG. 3 shows a perspective representation of a guide element of the holding frames.
Figure 4:
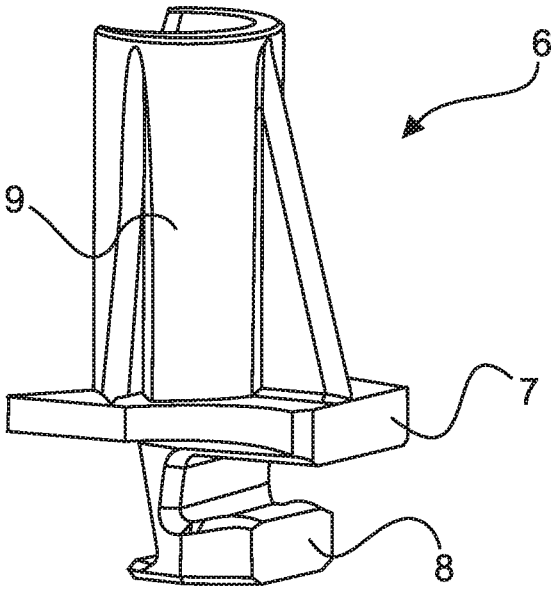
FIG. 4 shows a further perspective representation of the guide element.

A guide element 6 is shown in two differing perspectives in FIGS. 3 and 4. The guide element 6 comprises substantially a flat plane 7, from which a hook-shaped fixing element 8 projects on one side, and a guide sleeve 9 projects on the other side, perpendicularly in each case. By way of the hook-shaped fixing element 8, the halves 4, 5 of the holding frame 1 can be fixed to each other in the closed position.

Each holding frame 1, 1' has a grounding socket 11 and a grounding pin 12'. If two holding frames 1, 1' are plug-connected to each other, the grounding pin 12' of the one holding frame 1' engages in the grounding socket 11 of the other holding frame 1. The system composed of the grounding socket 11 and grounding pin 12' is not itself suitable for guiding the two holding frames 1, 1' in relation to each other. In the case of a pin and socket system, there must always be a certain amount of play present. This play could almost increase the damage and wear on the plug-in connector modules 19, 19'.

There is a guide rail 13 formed on the grounding socket 11. The guide sleeve 9 of the guide element 6 grips onto the guide rail 13 when two holding frames 1, 1' are plugged together. In this case, the inner wall 10 (FIG. 3) of the guide sleeve 9 glides on the guide rail 13. The holding frames 1, 1' are aligned exactly in relation to each other by these guide devices or means, namely, guide element 6 and guide rail 13. The plug-in connector modules 19, 19' are contacted with little wear. The plug-in connector modules 19, 19' may be pneumatic modules. Such pneumatic plug-in connector modules 19, 19' are particularly sensitive to wear if they are not plug-connected in exact alignment in relation to each other, since they must be air-tight on the plug-in side.

For the purpose of inserting the plug-in connector modules 19, 19', each holding frame 1, 1' is brought into an open position, as described above, such that the plug-in connector modules 19, 19' can be inserted. The frame halves 4, 5, 4', 5' are then brought into a closed position, as described above, with retaining devices or means (e.g., lugs 20, 20') of the plug-in connector modules 19, 19' going into recesses 23 of the holding frame 1, 1', and the plug-in connector modules 19, 19' being held in a secure, form-fitting manner in the holding frame 1, 1'.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame, in which plug-in connector modules can be inserted, the holding frame comprising:

a frame structure including a first lateral end and a second lateral end opposite the first lateral end;

a grounding socket provided at the first lateral end of the frame structure and extending in a plug-in direction of the holding frame, and being configured to insertably receive a corresponding grounding pin of a mating holding frame;

a grounding pin provided at the second lateral end of the frame structure and extending in the plug-in direction of the holding frame, and being configured for insertion in a corresponding grounding socket of the mating holding frame; and a guiding structure comprising a guide rail that is formed along a side of the grounding socket at the first lateral end of the frame structure and extends in the plug-in direction parallel to the grounding pin and the grounding socket, whereby the holding frame is configured to be aligned in a precision-fitting manner in relation to the mating holding frame in the plug-in direction by way of the guide rail engaging a corresponding guide sleeve of the mating holding frame.

2. The holding frame as claimed in claim 1, wherein the holding frame comprises two halves that are connected to each other, a first half and a second half.

3. The holding frame as claimed in claim 2, wherein the holding frame has a parting plane, which runs parallel to longitudinal sides of the halves of the holding frame, and wherein the holding frame has joints by which the halves are hinged to each other.

4. The holding frame as claimed in claim 1 further comprising a guide element having a guide sleeve that is provided adjacent to the grounding pin and configured to receive a corresponding guide rail of the mating holding frame.

5. The holding frame as claimed in claim 4 wherein the guide element has fixing means, by which halves of the holding frame can be fixed in a parallel position in relation to each other.

6. A system comprising a first holding frame and a second holding frame, each of the first holding frame and the second holding frame having:

a frame structure including a first lateral end and a second lateral end opposite the first lateral end;

a grounding pin provided at the first lateral end of the frame structure and extending in a plug-in direction of the holding frame, a grounding socket provided at the second lateral end of the frame structure and extending in a plug-in direction of the holding frame, the grounding socket of each one of the first holding frame and the second holding frame being configured to insertably receive the grounding pin of the other one of the first holding frame and the second holding frame, and a guiding arrangement, whereby the first holding frame and the second holding frame can be aligned together in a precision-fitting manner in the plug-in direction, wherein the guiding arrangement of the first holding frame includes a first guide rail that is formed along a side of the grounding socket at the second lateral end of the frame structure of the first holding frame and extends in the plug-in direction parallel to the grounding pin and the grounding socket, wherein the guiding arrangement of the second holding frame includes a second guide rail that is formed along a side of the grounding socket at the second lateral end of the frame structure of the second holding frame and extends in the plug-in direction parallel to the grounding pin and the grounding socket, wherein the first holding frame includes a first guide element with a first guide sleeve that grips onto the second guide rail of the guiding arrangement of the second holding frame, and wherein the second holding frame includes a second guide element with a second guide sleeve that grips onto the first guide rail of the guiding arrangement of the first holding frame.

7. The system as claimed in claim 6 wherein the system has at least two pneumatic plug-in connector modules, the first holding frame comprises a first one of the pneumatic plug-in connector modules and the second holding frame comprises a second one of the pneumatic plug-in connector modules, and the first pneumatic plug-in connector module and the second pneumatic plug-in connector module are aligned in relation to each other to be plugged-in together.

* * * * *